US012662636B2

(12) United States Patent
Jung et al.

(10) Patent No.: US 12,662,636 B2
(45) Date of Patent: Jun. 23, 2026

(54) METHOD AND SYSTEM FOR PREPARING SYNTHETIC OIL

(71) Applicant: SK Innovation Co., Ltd., Seoul (KR)

(72) Inventors: Jae Heum Jung, Daejeon (KR); Jae Hyun Koh, Daejeon (KR); Yong Tak Kwon, Daejeon (KR); Doo Ho Lee, Daejeon (KR); Ho Jeong Lee, Daejeon (KR); Yong Jeon Kim, Daejeon (KR); Ji Young Moon, Daejeon (KR); Ye Rhee Cha, Daejeon (KR)

(73) Assignee: SK Innovation Co., Ltd., Seoul (KR)

( * ) Notice: Subject to any disclaimer, the term of this patent is extended or adjusted under 35 U.S.C. 154(b) by 60 days.

(21) Appl. No.: 18/958,080

(22) Filed: Nov. 25, 2024

(65) Prior Publication Data

US 2026/0049249 A1 Feb. 19, 2026

(30) Foreign Application Priority Data

Aug. 19, 2024 (KR) ..... 10-2024-0110793

(51) Int. Cl.
*C10G 2/00* (2006.01)
*C10K 3/04* (2006.01)

(52) U.S. Cl.
CPC ..... *C10G 2/331* (2013.01); *C10K 3/04* (2013.01); *C10G 2300/10* (2013.01); *C10G 2300/4081* (2013.01); *C10G 2300/70* (2013.01)

(58) Field of Classification Search
CPC ..... C10G 2/231; C10G 23/10; C10G 2300/4081; C10G 2300/70; C10K 3/04
See application file for complete search history.

(56) References Cited

U.S. PATENT DOCUMENTS 2,608,568 A * 8/1952 Paul ..... C07C 1/045 518/728
6,147,126 A * 11/2000 DeGeorge ..... C07C 1/0485 518/703
2019/0084833 A1* 3/2019 Weedon ..... C10K 1/32

FOREIGN PATENT DOCUMENTS

KR 10-2001-0012162 A 2/2001
KR 10-2015-0037398 A 4/2015
KR 10-1860529 B 5/2018
KR 10-2022-0151690 A 11/2022
WO 1998/05485 11/1998
WO 2021/185827 9/2021

* cited by examiner

*Primary Examiner* — Jafar F Parsa
(74) *Attorney, Agent, or Firm* — Jones Day

(57) ABSTRACT

A method of preparing synthetic oil, the method including producing synthetic gas by introducing the feed into a synthetic gas production reaction in the presence of a catalyst, producing synthetic oil and an FT tail gas by introducing the synthetic gas into a Fischer-Tropsch (FT) reaction, regenerating the catalyst used in the producing of the synthetic gas in a catalyst regenerator, and supplying the FT tail gas to a catalyst regenerator.

20 Claims, 3 Drawing Sheets

METHOD AND SYSTEM FOR PREPARING SYNTHETIC OIL

CROSS REFERENCE TO RELATED APPLICATION

The present application claims priority to Korean Patent Application No. 10-2024-0110793, filed Aug. 19, 2024, the entire contents of which is incorporated herein for all purposes by this reference.

BACKGROUND OF THE DISCLOSURE

1. Field of the Disclosure

The present disclosure relates to method and system for preparing synthetic oil using a Fischer-Tropsch (FT) tail gas.

2. Description of the Related Art

According to the dictionary, "biomass" is a portmanteau word of bio, meaning biological origin, and mass, meaning material. Accordingly, biomass refers to a material of biological origin. "Biogenic" refers to the state of originating from photosynthetic products of plants, which are primary producers. The photosynthetic products, within which solar energy is organically stored, are transferred and delivered to secondary and tertiary consumers and decomposers through the food chain. All products generated in this process may be referred to as biomass. Most biological organisms fall into the category of biomass. Even emissions (for example, feces and urine) generated by biological organisms carrying out their life cycle, and the remains of plants and animals generated by the death of biological organisms originate from living things. Thus, the emissions and the remains may also fall in the biomass category.

"Municipal solid waste (MSW)" refers to solid waste generated in cities or communities. MSW refers to organic and inorganic materials such as food waste, paper, wood, waste plastic, waste vinyl, and waste iron. MSW has relatively uniform properties and is discharged in a relatively constant amount. Thus, it is advantageous to find uses for the MSW as an energy source.

Techniques for converting biomass and MSW into other forms of energy include direct combustion and gasification. Direct combustion is a method of obtaining heat energy through incineration. However, incineration may generate greenhouse gases, such as carbon dioxide, and fine dust. Gasification is a technique to produce synthetic gas containing carbon monoxide and hydrogen, which may be used to produce synthetic oil, e.g., through a Fischer-Tropsch (FT) reaction. However, a tail gas is produced as by-product in the Fischer-Tropsch reaction, which can pollute the environment. Therefore, recently, research has been conducted to use tail gas more efficiently.

SUMMARY OF THE DISCLOSURE

One aspect of the present disclosure provides methods and systems for preparing synthetic oil in an economically and environmentally friendly manner through the suppression of greenhouse gas emissions, e.g., by reusing FT tail gas as an energy source. This is achieved by regenerating a reforming catalyst with the use of FT tail gas as a regenerant.

In one aspect, the present disclosure provides a method of preparing synthetic oil, the method comprising:

producing a reformed synthetic gas from a feed comprising a carbon material using a catalyst;

subjecting the reformed synthetic gas to a Fischer-Tropsch (FT) process to produce synthetic oil and an FT tail gas;

regenerating the catalyst in a catalyst regenerator; and supplying the FT tail gas to the catalyst regenerator.

In one embodiment, the producing of the reformed synthetic gas comprises a gasification reaction. In one embodiment, producing the reformed synthetic gas comprises a partial oxidation reaction, a catalytic reforming reaction, a water-gas shift reaction, a hydrogen injection, or any combination thereof. In one embodiment, producing the reformed synthetic gas comprises physically or chemically scrubbing the reformed synthetic gas. In one embodiment, the method further comprises adjusting the FT tail gas to a temperature in a range of about 400° C. to about 1,000° C. before supplying the FT tail gas to the catalyst regenerator.

In one embodiment, the adjusting of the temperature of the FT tail gas comprises partially combusting the FT tail gas, pre-heating the FT tail gas, or a combination thereof. In one embodiment, the method further comprises adjusting the catalyst regenerator temperature to a range of about 400° C. to about 1,000° C. In one embodiment, the adjusting of the temperature of the catalyst regenerator is carried out by heating the catalytic regenerator with an electric heater or an inductive heater. In one embodiment, the adjusting of the reaction temperature of the catalyst regenerator further comprises partially combusting the FT tail gas with oxygen. In one embodiment, the catalyst comprises one or more of a nickel-based catalyst, an iron-based catalyst, a cobalt-based catalyst, a ruthenium-based catalyst, a platinum-based catalyst, or a rhodium-based catalyst. In one embodiment, the producing of the reformed synthetic gas is carried out in two or more reactors operating in swing mode. In one embodiment, the producing of the reformed synthetic gas is carried out in a circulating fluidized bed reactor. In one embodiment, the method comprises produces a catalyst regenerator tail gas from the catalyst regenerator and wherein the catalyst regenerator tail gas is introduced into one or more processes downstream of producing the reformed synthetic gas.

In another aspect, the present disclosure provides a system for preparing synthetic oil, the system comprising:

a section for producing a reformed synthetic gas comprising:
- a feed inlet; and
- one or more reactors to generate a reformed synthetic gas in the presence of a catalyst;

a section for carrying out a Fischer-Tropsch (FT) process comprising:
- an inlet for introducing the reformed synthetic gas;
- an outlet for discharging synthetic oil;
- an outlet for discharging an FT tail gas;

a section for regenerating the catalyst comprising a catalyst regenerator; and a recirculating conduit for supplying the FT tail gas to the section for regenerating catalyst.

In one embodiment, the system further comprises a preheater, a pre-combustor, or a combination thereof downstream of the recirculating conduit for supplying the FT tail gas to the section for regenerating catalyst. In one embodiment, the system further comprises a catalyst regenerator tail gas conduit for transporting tail gas generated from the catalyst regenerator to a catalytic reformer in the section for producing a reformed synthetic gas. In one embodiment, the system further comprises one or more oxygen inlets. In one embodiment, the tail gas conduit for transporting tail gas generated from the catalyst regenerator to a catalytic reformer comprises an oxygen inlet. In one embodiment, the recirculation conduit comprises an oxygen inlet. In one embodiment, the catalyst regenerator comprises an oxygen inlet.

According to a still yet further embodiment of the present disclosure, method, and system for producing synthetic oil can be improved economically and environmentally friendly.

DESCRIPTION OF THE PREFERRED EMBODIMENTS

Figure 1:
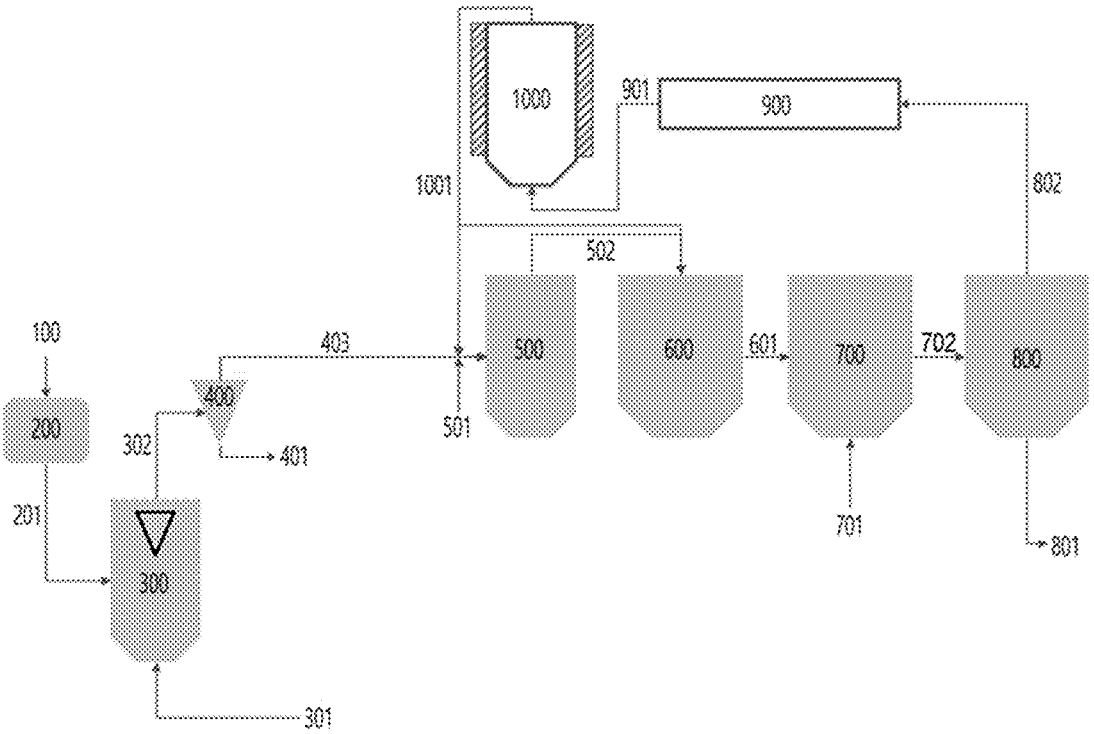
FIG. 1 is a flowchart of an exemplary process or system for preparing synthetic oil according to one embodiment.

Disclosed herein are methods and systems for producing synthetic oil that are energy efficient and therefore economically and environmentally friendly. Certain embodiments of the invention are described in present disclosure with reference to the attached drawings. However, the drawings are merely illustrative and the invention is not limited to the specific embodiments described in the drawings and examples herein.

Use of the term "about" herein refers to the nominal value plus or minus 5% of that nominal value. For example, "about 100" refers to a value of 95 to 105.

In one aspect, the present disclosure provides a method of preparing synthetic oil, the method comprising:

- producing a reformed synthetic gas from a feed comprising a carbon material using a catalyst;
- subjecting the reformed synthetic gas to a FT process to produce synthetic oil and an FT tail gas;
- regenerating the catalyst in a catalyst regenerator; and
- supplying the FT tail gas to the catalyst regenerator.

In one embodiment, the method of preparing synthetic oil, wherein the method comprises:

- providing a feed including a carbon material;
- producing a reformed synthetic gas by introducing the feed into a synthetic gas production reaction in the presence of a catalyst;
- producing synthetic oil and an FT tail gas by introducing the reformed synthetic gas into a Fischer-Tropsch (FT) reactor;
- regenerating the catalyst used in the producing of the reformed synthetic gas in a catalyst regenerator; and
- supplying the FT tail gas to the catalyst regenerator.

Producing a Reformed Synthetic Gas

In certain embodiments, the process of producing a reformed gas from a feed comprising a carbon material comprises a gasification reaction. In certain embodiments, the process of producing a reformed gas comprises or further comprises a partial oxidation reaction, a catalytic reforming reaction, a water-gas shift reaction, a hydrogen injection, or any combination thereof. In certain embodiments, the process of producing a reformed gas from a feed comprises a gasification reaction and a catalytic reforming reaction. In certain embodiments, the process of producing a reformed gas from a feed comprises a gasification reaction, a partial oxidation reaction, and a catalytic reforming reaction. Further details of exemplary steps, systems, and reactions that may be undertaken to produce a reformed synthetic gas from a feed are described below with reference to FIG. 1. As will be detailed herein, FIG. 1 depicts some, but not all, components that may be used to produce a reformed synthetic gas. Further, FIG. 1 depicts components in a particular arrangement, however, as will be described, suitable arrangements are not limited to what is depicted in FIG. 1 and some elements, such as a scrubber, may be incorporated at other locations in the system or process.

FIG. 1 provides a flowchart of an exemplary process or system for preparing synthetic oil and reusing an FT tail gas generated therefrom in an energy efficient manner according to one embodiment. In FIG. 1, a feed inlet 100 provides a feed comprising a carbon material is provided. The feed from which a reformed synthetic gas may be produced may be any carbon-based material. For example, the carbon-containing material may comprise one or more materials selected from the group consisting of coal, biomass, and MSW, or any mixture thereof. Herein, MSW may also be referred to as "waste."

In one embodiment, the feed may be sorted depending on its properties, such as source, size, type, and moisture content, with a sorter 200, before being subjected to further reactions, e.g., gasification reaction, partial oxidation reaction, catalytic reforming reaction, etc. The sorting process may begin with a size separation step, wherein the MSW is screened to separate larger items from smaller particles. This initial separation removes bulky items such as plastics, metals, and glass, thereby contributing to a more homogeneous feedstock. Next, a magnetic separation step may be employed to extract ferrous metals from the waste stream, improving the quality of the remaining material. Non-magnetic metals are subsequently removed via eddy current separation, which targets non-ferrous metals like aluminum to further reduce contaminants. Following metal removal, the waste may undergo air classification to separate lighter materials, such as paper and plastics, from denser materials, such as glass and metals, based on their density differences. This classification ensures a consistent and optimized feed for the gasification process. An optical sorting step then may use visible and infrared light to differentiate and separate various types of plastics and other materials based on their optical properties. This step enables further refinement of the feedstock composition. Finally, the sorted materials may undergo a shredding and crushing step, wherein they are processed to achieve a uniform particle size suitable for introduction into the gasification reactor. This method enhances the efficiency of gasification by providing a cleaner, more consistent feedstock while maximizing the energy recovery potential from municipal solid waste. During sorting, metal components may be removed from the feed to produce a carbonaceous raw material 201 (which may also be referred to as carbon-containing material).

In one embodiment, the process of producing a synthetic gas may comprise a gasification reaction in which a carbonaceous raw material 201 containing carbon in a solid or liquid state is steamed in a gasifier 300 to produce a steamed carbonaceous raw material. Thereafter, the steamed carbonaceous raw material may be reacted with a gasifying agent 301 (for example, carbon dioxide and oxygen) in the presence of a catalyst in the gasifier 300 to convert the steamed carbonaceous raw material into a first synthetic gas 302, the main components of which are carbon monoxide and hydrogen.

In certain embodiments, the first synthetic gas 302 may further comprise components such as carbon dioxide and methane. The first synthetic gas 302 leaving the gasifier 300 may also comprise impurities such as tar, solid ash, slag, or any combination thereof.

In one embodiment, the gasifying agent 301 comprises water, carbon dioxide, oxygen, or a mixture of any thereof. Examples of products that may be generated in the gasifier include hydrogen ($H_2$), carbon monoxide (CO), carbon dioxide ($CO_2$), methane ($CH_4$), and water ($H_2O$). Examples of reactions that may occur in the gasifier 300 are listed below:

$$C + H_2O \leftrightarrow CO + H_2 \quad (1)$$

$$C + CO_2 \leftrightarrow 2CO \quad (2)$$

$$C + O_2 \leftrightarrow CO_2 \quad (3)$$

$$CO + 3H_2 \leftrightarrow CH_4 + H_2O \quad (4)$$

$$CH_4 + H_2O \leftrightarrow CO + 3H_2 \quad (5)$$

$$CH_4 + CO_2 \leftrightarrow 2CO + 2H_2 \quad (6)$$

$$CH_4 + 2O_2 \leftrightarrow CO_2 + 2H_2O \quad (7)$$

The catalyst used in the gasification reaction may be any general catalyst known to one of skill in the art suitable for converting a carbon-containing material 201 into carbon dioxide and hydrogen. In certain embodiments, the catalyst comprises an alkali metal, alkaline earth metal, or a transition metal. Non-limiting examples of suitable alkali metals that may be used for the catalyst include lithium (Li), sodium (Na), potassium (K), rubidium (Rb), cesium (Cs), and francium (Fr). Non-limiting examples of suitable alkaline earth metals that may be used for the catalyst include magnesium (Mg) and calcium (Ca). Non-limiting examples of suitable transition metals that may be used for the catalyst include iron (Fe), nickel (Ni), cobalt (Co), copper (Cu), and zinc (Zn). It will be apparent to those skilled in the art that other metal components suitable for the purposes of the present disclosure may also be used.

Optionally, the first synthetic gas 302 produced in gasifier 300 may be further passed through a secondary gasifier (not shown in FIG. 1) to maximize conversion of carbon materials. A secondary gasifying reaction occurring in a secondary gasifier may comprise reacting the first synthetic gas with a second gasifying agent in the presence of catalyst. The second gasifying agent may be any gasifying agent as described for use herein. Similarly, the catalyst may also be any catalyst as described herein.

In one embodiment, the first synthetic gas 302 discharged from gasifier 300 may pass through one or more of a cyclone 400, a gas filter (not shown), a gas absorber (not shown), and a gas adsorber (not shown). In the process shown in FIG. 1, the first synthetic gas 302 discharged from gasifier 300 (or secondary gasifier) is passed through a cyclone 400. As used herein, "cyclone" refers to a device that uses centrifugal force to separate solid particles from a mixture containing the solid particles. The cyclone may be any conventional cyclone known in the art. A cyclone 400 may be used to remove undesirable solid materials 401, such as particles of solid ash and slag, from the first synthetic gas 302 to produce a second synthetic gas 403. Undesirable material may be those scattered from the gasifier 300, such as catalyst, unreacted feed, solid ash, and slag.

In certain embodiments, the cyclone 400 may remove particles greater than about 10 μm in size, and a gas filter, e.g., downstream of the cyclone, may remove finer particles greater than about 1 μm in size. Accordingly, optionally, a gas filter (not shown) may be further installed downstream of the cyclone 400. The gas filter may filter out significantly small dust and particles in the second synthetic gas 403 exiting the cyclone 400.

A gas absorber (not shown) or a gas adsorber (not shown) may be located upstream or downstream of the cyclone 400 and/or gas filter. The gas absorber and/or gas adsorber may remove one or more of hydrogen sulfide ($H_2S$), hydrogen chloride (HCl), and ammonia ($NH_3$) from the first synthetic gas 302 and/or second synthetic gas 403. In certain embodiments, the gas absorber and/or gas adsorber may remove metal atoms from one or more of the gasses through vaporization or sublimation. Additionally, the gas absorber and/or gas adsorber may be used to remove other organic and inorganic impurities that may be present in one or more of the gasses.

The second synthetic gas 403 discharged from the cyclone 400 (or any gas absorber or adsorber downstream thereof) may be introduced into a catalytic reformer 500 (which may also be referred to as a catalytic reforming reactor) to undergo a catalytic reforming reaction to produce a reformed synthetic gas 502.

Partial Oxidation

In one embodiment, the producing of the synthetic gas may involve a partial oxidation reaction by passing the second synthetic gas 403 discharged from the cyclone 400 (or any gas absorber or adsorber downstream thereof) through a partial oxidation reactor (not shown in FIG. 1) before being introduced into the catalytic reformer 500. For example, the stream of a first synthetic gas 302 discharged from a gasifier 300 may comprise methane. Methane may be converted to carbon monoxide and hydrogen through a partial oxidation reaction represented by reaction equation (8) below:

$$CH_4 + 1/2O_2 \leftrightarrow CO + 2H_2 \quad \Delta H^{\circ}_{298} = -36 \text{ kJ/mol} \quad (8)$$

Catalytic Reforming

According to the present disclosure, producing the synthetic gas comprises a catalytic reforming reaction. In one embodiment, producing the synthetic gas comprises processing the feed sequentially in a gasifier and catalytic reformer. In another embodiment, producing the synthetic gas comprises processing the feed sequentially in a gasifier, a partial oxidation reactor, and a catalytic reformer.

A first synthetic gas 302 discharged from the gasifier 300 (or gas adsorber, or gas absorber) or second synthetic gas 403 discharged from one or more of a cyclone 400, gas filter, gas adsorber, or gas absorber) may comprise methane and hydrocarbons having two (2) or more carbon atoms, which are converted to carbon monoxide and hydrogen via a catalytic reforming reaction in a catalytic reformer 500.

In one embodiment, the catalytic reforming reaction may convert methane into carbon monoxide and hydrogen via a steam methane reforming (SMR) reaction represented by equation (9) below:

$$CH_4 + H_2O \leftrightarrow CO + 3H_2 \quad \Delta H^{\circ}_{298} = 206 \text{ kJ/mol} \tag{9}$$

The catalytic reforming reaction may convert hydrocarbons having two (2) or more carbon atoms into carbon monoxide and hydrogen via a steam reforming reaction represented by equation (10) below:

$$C_xH_y + zH_2O \leftrightarrow pCO + qH_2 \tag{10}$$

In Equation (10), x, y, z, p, and q are each independently integers of 2 or more.

The reactions represented by Equations (9) and (10) are carried out in the presence of a catalyst. In one embodiment, the catalyst comprises used in the steam reforming reactions of equations (9) and (10) may comprise a transition metal (for example, Ni, Fe, and Co)-based catalyst or a noble metal (for example, ruthenium (Ru), platinum (Pt), and rhodium (Rh))-based catalyst. Preferably, the catalyst used in the steam reforming reaction may include Ni, Fe, Co, etc., and Bimetallic material thereof with $Al_2O_3$ as carrier (Ni—$Al_2O_3$, NiFe—$Al_2O_3$, NiMgK—$Al_2O_3$, Rh—$Al_2O_3$. The catalyst may also include alkali earth metal such as Mg, Ce, and lanthanide.

In one embodiment, the catalytic reforming reaction may convert methane or higher hydrocarbons into carbon monoxide and hydrogen via a dry reforming reaction represented by the equations (11) and (12) below:

$$CH_4 + CO_2 \leftrightarrow 2CO + 2H_2 \quad \Delta H^{\circ}_{298} = 247.44 \text{ kJ/mol} \tag{11}$$

$$C_xH_y + zCO_2 \leftrightarrow pCO + qH_2 \tag{12}$$

In Equations (11) and (12), x, y, z, p, and q are each independently integers of 2 or more.

The reactions represented by Equations (11) and (12) are carried out in the presence of a catalyst. In one embodiment, the catalyst used in the dry reforming reaction may comprise a transition metal (for example, Ni, Fe, and Co)-based catalyst or a noble metal (for example, Ru, Pt, and Rh)-based catalyst. The catalytic reformer may be any reactor known to one of skill in the art. For example, in one embodiment, the catalytic reformer 500 may be a fluidized bed reactor. The catalyst may flow within the fluidized bed reactor, thereby efficiently facilitate the steam reforming reaction of hydrocarbons (for example, methane) or the dry reforming reaction between hydrocarbons (for example, methane) and carbon dioxide. In such embodiments, the conversion rate of the hydrocarbons, such as methane, to carbon monoxide and hydrogen may be significantly increased, thereby generating large amounts of carbon monoxide and hydrogen.

In certain other embodiments, the catalytic reformer 500 may be a fixed bed reactor. Reactants including hydrocarbons, such as methane, may be converted in a steam reforming reaction or a dry reforming reaction by passing through a catalyst layer.

In certain other embodiments, the catalytic reformer 500 may be a circulating fluidized bed reactor. The circulating fluidized bed reactor may comprise a reaction section and a catalyst regenerator in communication with the reaction section. Deactivated catalyst in the reaction section may be transferred to and regenerated in the catalyst regenerator. The catalyst regenerated in the catalyst regenerator may then be transferred back to the reaction section. Accordingly, the catalyst may be regenerated in situ in the circulating fluidized bed reactor.

Swing Mode

In one embodiment, the catalytic reforming reaction may operate in a so-called swing mode wherein two or more reactors are connected in parallel to each other. For example, when the operation of the catalytic reformer 500 in a system comprising only one catalytic reformer is stopped to replace a catalytic reforming layer or regenerate a catalyst, the entire production process must be stopped. As such, stopping the operation of the catalytic reformer 500 to regenerate catalyst can have greatly lowering the operation efficiency of the entire synthetic gas production process.

To overcome this challenge, catalytic reforming reaction may be performed in swing mode in two or more catalytic reforming reactors. When one reactor is in regeneration mode to regenerate a catalyst, a second reactor may be in operation mode to continue producing synthetic gas. Therefore, the catalytic reforming may be performed continuously.

By using the methods and systems disclosed herein, a reformed synthetic gas 502, comprising mainly hydrogen and carbon monoxide, may be discharged from the catalytic reformer 500. The reformed synthetic gas 502 may then be used as a raw material or reactant, e.g., for a downstream water-gas shift reaction or Fischer-Tropsch (FT) reaction to prepare synthetic oil, as will be described in further detail below.

Producing Synthetic Oil

After being formed, a reformed synthetic gas may be passed through one or more of a scrubber and a water-gas shift reactor before being introduced into an FT reactor to produce synthetic oil. Further details of exemplary steps, systems, and reactions that may be undertaken to produce a synthetic oil from a reformed synthetic gas are described below with continued reference to FIG. 1.

In FIG. 1, the reformed synthetic gas 502 is passed through a scrubber 600 and a water-gas shift reactor 700 before being introduced into a FT reactor 800 to produce synthetic oil 801. In some embodiments, a scrubber 600 alternatively or additionally may be located upstream or downstream of a partial oxidation reactor or upstream of the catalytic reformer 500 as described above with respect to the production of the synthetic gas. In some embodiments, a scrubber 600 may be located downstream of the water-gas shift reactor 700.

Scrubbing

The scrubber may be any scrubber known to one of skill in the art to remove catalyst particles, tar, and $H_2S$, for example, a water scrubber, venturi scrubber, or oil scrubber. During scrubbing, a scrubber solution may be sprayed into a synthetic gas stream, e.g., first or second synthetic gas or any intermediate gas stream) to remove solid impurities (for example, catalyst particles), liquid impurities (for example, tar), and/or gaseous impurities (for example, $H_2S$). The scrubber solution may be selected depending on the type of impurities in the gas. The scrubber solution may comprise, for example, water, oil, and/or NaOCl solution. Solid and liquid impurities may be thus removed by the scrubber solution to produce a scrubbed synthetic gas 601.

Water-Gas Shift Reaction

The process of preparing synthetic oil may comprise a water-gas shift reaction to maintain a desired $H_2$/CO ratio of the synthetic gas 702 flowing into an FT reactor 800, e.g., at a ratio of 2. Optionally, a hydrogen input line 701 may introduce hydrogen into a water-gas shift reactor 700 to maintain the desired $H_2$/CO ratio, e.g., at 2. The water-gas shift reaction may be expressed as equation (13) below:

$$CO + H_2O \leftrightarrow CO_2 + H_2 \quad \Delta H = -41.1 \text{ kJ/mol} \tag{13}$$

The catalyst used in the water-gas shift reaction may be any suitable catalyst known to one skilled in the art. For example, in one embodiment, the catalyst used in the water-gas shift reaction may be a platinum-based catalyst, an iron-based catalyst, or a copper-based catalyst. The water-gas shifted gas 702 may then be fed into a FT reactor 800.

Fischer-Tropsch Reaction

The reformed synthetic gas 502, having optionally been passed through a scrubber 600 to produce a scrubbed gas 601, and/or a water-gas shift reactor 700 to produce a water-gas shifted gas 702, may then be subjected to an FT process, e.g., by feeding it into a FT reactor 800 to produce synthetic oil and an FT tail gas.

In one embodiment, a scrubbed synthetic gas 602 is introduced into the FT reactor.

In one embodiment, a water-gas shifted synthetic gas 702 is introduced into the FT reactor.

The FT reaction that occurs in the FT reactor may be expressed as equation (14) below.

$$(2n+1)H_2 + nCO \rightarrow C_nH_{2n+2} + nH_2O \tag{14}$$

In Equation (14) n is an integer from 10-20.

In one embodiment, the FT reaction may be carried out at a temperature in a range of about 200° C. to about 350° C. in the presence of a Fe, Co, or Ru-based catalyst.

Alkanes produced in the FT reaction are generated in liquid phase and are the main constituent of the synthetic oil 801 thus produced. The alkanes in the synthetic oil 801 typically have 10 to 20 carbon atoms.

Unreacted components of the synthetic gas that have not been involved in the FT reaction (for example, $H_2$) and an FT tail gas comprising light hydrocarbons generated from the FT reaction (for example, CO, $CO_2$, and $CH_4$), may be discharged from the FT reactor 800 and used, as will be described below, to regenerate catalyst.

Catalyst Regeneration

The method of preparing synthetic oil according to the present disclosure may further include regenerating a catalyst, such as the catalyst used to produce reformed synthetic gas. For example, a catalyst used in a catalytic reformer 500 may be regenerated in a catalyst regenerator 1000.

In one embodiment, an FT tail gas from the FT reactor 800 may be supplied to the catalyst regenerator 1000 via a recirculating conduit 802 to regenerate the catalyst.

In one embodiment, carbon adsorbed on the catalyst may be removed to regenerate catalyst by reacting the carbon with carbon dioxide or water in the FT tail gas, as described in equations (15) and (16) below:

$$C + CO_2 \rightarrow 2CO \quad \Delta H^O = 172.4 \text{ kJ/mol} \tag{15}$$

$$C + H_2O \rightarrow CO + H_2 \quad \Delta H^O = 131.3 \text{ kJ/mol} \tag{16}$$

Sulfur adsorbed on the catalyst (M) may be removed by reacting the sulfur with hydrogen in the FT tail gas, as shown in equations (17), (18), and (19) below, and as a result, the catalyst (M) may be regenerated.

When the sulfur is chemisorbed on the catalyst (M), the catalyst may be regenerated by the mechanisms below.

When an FT tail gas comprises $H_2$ but not steam, the reaction according to equation (17) may occur:

$$M\text{–}S(\text{chemisorbed}) + H_2 \rightarrow M + H_2S \tag{17}$$

When an FT tail gas comprises both steam and $H_2$, the reactions according to equations (18) and (19) may occur:

$$M\text{–}S + H_2O \rightarrow M\text{–}O + H_2S \tag{18}$$

$$M\text{–}O + H_2 \rightarrow M + H_2O \tag{19}$$

When the sulfur is adsorbed on the catalyst, the catalyst may be regenerated by the mechanisms below.

When an FT tail gas comprises $H_2$ but not steam, the reaction according to equation (20) may occur:

$$MSx + H_2 \rightarrow M + H_2S, \tag{20}$$

In Equation (20), x is an integer of 1 or more.

When an FT tail gas comprises both steam and $H_2$, the reactions according to equations (21) and (22) may occur:

$$MSx + H_2O \rightarrow MOx + H_2S \tag{21}$$

$$MOx + H_2 \rightarrow M + H_2O \tag{22}$$

In one embodiment, exhaust gasses, such as CO and $H_2$, generated in regenerating the catalyst may be used as a feed or to supplement the feed for the downstream FT process.

Unfortunately, when carbon dioxide and steam from FT tail gasses are discharged into the atmosphere, they may cause environmental pollution problems, such as the greenhouse effect. To mitigate this issue, $CO_2$ in the synthetic gas may be removed in an amine absorption tower (not shown) upstream of an FT reactor 800, so the $CO_2$ included in the FT tail gas may remain in a trace amount. Water generated in the FT reaction may be passed through a three-phase separator (not shown) downstream of the FT reactor 800 to be separated into tail gas/water/oil, so the steam included in the FT tail gas may remain in a trace amount.

Advantageously, the methods provided by the present disclosure to produce synthetic oil, the FT tail gas (comprising carbon dioxide, steam, and hydrogen) may be recycled and used to regenerate a reforming catalyst. As such, the method and system for preparing synthetic oil of the present disclosure eliminates the need to use a separate regeneration gas. Therefore, the method and system are economical since they reduce the amount of the regenerant used and the use of utility. Furthermore, the method and system represent an environmentally friendly improvement since they alleviate greenhouse effect problems.

Further, FT tail gas may be used to optimize one or more upstream processes. For example, optionally, a catalytic reformer may comprise a heater to increase the temperature of the synthetic gas passing through the catalytic reforming layer and to increase the temperature of the catalytic reforming layer. In one embodiment, the heater is in contact with the catalytic reforming layer. The heater may facilitate the reforming reaction by raising the temperature of the synthetic gas, which may have been lost during transport the gas to a temperature necessary for the reforming reaction. In one embodiment, the catalyst reforming layer may be maintained at a temperature in a range of about 400° C. to about 1,000° C., for example, about 450° C. to about 950° C., about 500° C. to about 900° C., about 550° C. to about 850° C., about 600° C. to about 800° C., about 650° C. to about 750° C., or at any temperatures within the aforementioned ranges or sub-ranges.

However, to maintain the temperature of the catalyst reforming layer in a range of about 400° C. to about 1,000° C., a heater may need to be operated continuously, which may require a large amount of electrical energy. As such, the heater contribute significantly to lowering of the energy efficiency of the entire system. To alleviate this issue, tail gas, which is discharged at a high temperature after the regenerating of the catalyst may be introduced back into catalytic reformer to supply the needed energy source and reduce reliance on a heater. Impurities in the tail gas may be removed upstream and/or downstream of the synthetic gas production facility.

However, in certain embodiments, the temperature of the FT tail gas leaving the FT reactor 800 via the recirculating conduit 802 may not be optimal. For example, when the temperature of the FT tail gas entering the catalyst regenerator 1000 is lower than 400° C., the catalyst regeneration reaction may be lowered. Conversely, when the tail gas has a temperature exceeding 1,000° C., the catalyst may become thermally unstable.

Accordingly, in one embodiment, a pre-heater 900 may be used to adjust the temperature of the FT tail gas before supplying the FT tail gas to the catalytic regenerator. For example, in one embodiment, the method may further comprise adjusting the temperature of FT tail gas to a range of about 400° C. to about 1,000° C., for example, about 450° C. to about 950° C., about 500° C. to about 900° C., about 550° C. to about 850° C., about 600° C. to about 800° C., about 650° C. to about 750° C., or at any temperatures within the aforementioned ranges or sub-ranges. Although the pre-heater may require some energy, such energy is expected to be much lower than the energy required by a heater to maintain the temperatures of the catalyst regenerator in absence of the energy supplied by the FT tail gas. Accordingly, even when using a pre-heater, the processes and systems disclosed herein are still more energy-efficient than those not using the FT tail gas as an energy source.

By using the methods and systems disclosed herein, a synthetic oil may be prepared in an economically and environmentally-friendly manner, reducing or eliminating use of a separate heating medium, and instead using or supplementing with energy from the FT tail gas.

Figure 2:
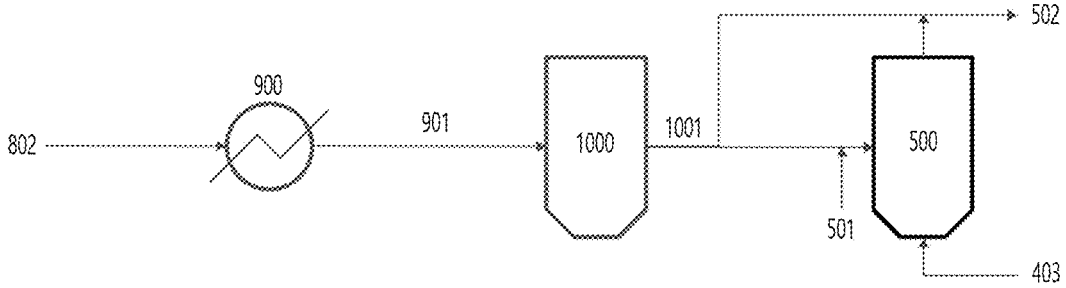
FIG. 2 is a flow diagram of an exemplary process or system for pre-heating an FT tail gas.

FIG. 2 is a flow diagram of an exemplary process for pre-heating an FT tail gas according one embodiment. Referring to FIG. 2, the FT tail gas may be passed via a recirculating conduit 802 to a preheater 900, such as, a gas firing heater, an electric heater, or an induction heater, but the heater type is not limited thereto. In certain embodiments, the pre-heater 900 may increase the temperature of the FT tail gas to a temperature in a range of about 400° C. to about 1,000° C., for example, about 450° C. to about 950° C., about 500° C. to about 900° C., about 550° C. to about 850° C., about 600° C. to about 800° C., about 650° C. to about 750° C., or at any temperatures within the aforementioned ranges or sub-ranges, to generate a pre-heated FT tail gas 901.

When the reforming catalyst is regenerated in the catalyst regenerator 1000 using the pre-heated FT tail gas 901, the reforming catalyst may be supplied to the catalytic reformer 500 and reused as a catalyst for the reforming reaction. Through this configuration, the problem of catalyst deactivation is solved, and there is no need to continuously introduce new catalyst for the reforming reaction, as is the case in the conventional art. Therefore, this may result in significant cost savings. When used in combination with regenerating the reforming catalyst in a swing mode together with the catalytic reforming, catalytic reforming may be carried out continuously without interruption.

Catalytic generator tail gas 1001 discharged from the catalytic regenerator may have a temperature in a range of about 400° C. to about 1,000° C., for example, about 450° C. to about 950° C., about 500° C. to about 900° C., about 550° C. to about 850° C., about 600° C. to about 800° C., about 650° C. to about 750° C., or at any temperatures within the aforementioned ranges or sub-ranges. Accordingly, catalyst regenerator tail gas may be discharged from the catalyst regenerator to the catalytic reforming reactor to provide the reaction heat necessary for the catalytic reforming reaction, thereby reducing or eliminating the need for a separate heating mechanism for the catalytic reformer. Further, tail gas 1001 may also be as a raw material for the catalytic reforming reaction to increase the production yield of hydrogen and carbon monoxide. For example, in FIG. 2, a catalyst regenerator tail gas 1001 discharged from the catalyst regenerator 1000 is introduced into the catalytic reforming reactor 500. Optionally, a first oxygen inlet 501 may supply oxygen to the catalyst regenerator tail gas 1001 discharged from the catalyst regenerator 1000 to oxidize the catalyst regenerator tail gas 1001 under oxidizing conditions to provide or supplement the reaction heat necessary for the catalytic reforming reaction in the catalytic reforming reactor 500. For example, an oxidized catalyst regenerator tail gas may have a temperature in a range of about 2,000° C. to about 3,000° C., for example, about 2,100° C. to about 2,900° C., about 2,200° C. to about 2,800° C., about 2,300° C. to about 2,700° C., about 2,400° C. to about 2,600° C., or at any temperatures within the aforementioned ranges or sub-ranges. Impurities included in the tail gas may also be oxidized and recirculated to produce the synthetic gas.

Figure 3:
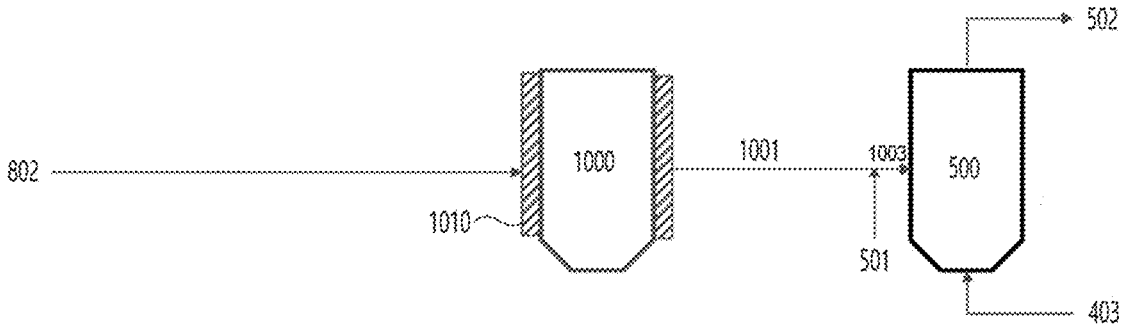
FIG. 3 is a flowchart of an exemplary process or system for supplying reaction heat to a catalyst regenerator.

FIG. 3 is a flowchart of an exemplary process for supplying reaction heat to a catalyst regenerator according to one embodiment. The recirculated FT tail gas may be introduced to the catalyst regenerator 1000 without preheating. Instead, the recirculated FT tail gas may transported to the catalytic regenerator 1000 and heated therein, e.g., by an electric heater or an inductive heater, but the heater type is not limited thereto. For example, the recirculated FT tail gas (transported by circulating conduit 802) may be heated by a heater 1010 to a temperature in a range of about 400° C. to about 1000° C., for example, about 450° C. to about 950° C., about 500° C. to about 900° C., about 550° C. to about 850° C., about 600° C. to about 800° C., about 650° C. to about 750° C., or at any temperatures within the aforementioned ranges or sub-ranges.

Referring still to FIG. 3, the catalyst regenerator tail gas 1001 discharged after regenerating the reforming catalyst in the catalyst regenerator 1000 may be introduced into the catalytic reforming reactor 500. Alternatively, impurities may be removed from the catalyst regenerator tail gas 1001 or the regenerator tail gas may be oxidized before introducing the catalyst regenerator tail gas 1001 may be introduced into the catalytic reforming reactor 500 after removing impurities or may be oxidized before being introduced into the catalytic reformer, e.g., to supply heat to the downstream process. The oxidized catalyst regenerator tail gas 1003 introduced into the catalytic reforming reactor 500 may be additionally used as a raw material and fuel in the catalytic reforming reaction, thereby increasing the production yield of hydrogen and carbon monoxide. In the catalytic reformer 500, the oxidized catalyst regenerator tail gas 1003 is mixed with the second synthetic gas 403 to generate a recycled mixed feed, which may have a temperature in a range of about 700° C. to about 1,000° C., for example, about 750° C. to about 950° C., about 800° C. to about 900° C., about 850° C. to about 900° C., or at any temperatures within the aforementioned ranges or sub-ranges. Accordingly, the catalyst regenerator tail gas 1001 discharged from the catalyst regenerator 1000 may provide the reaction heat necessary for the catalytic reforming reaction in the catalytic reforming reactor 500.

Figure 4:
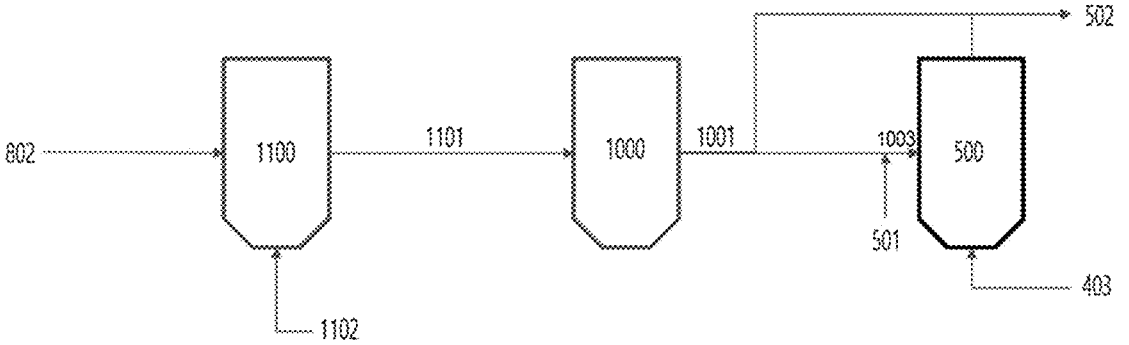
FIG. 4 is a flowchart of an exemplary process or system for supplying reaction heat to a catalyst regenerator.

FIG. 4 is a flowchart of an exemplary process for supplying reaction heat to the catalyst regenerator 1000 according to yet a further embodiment. The recirculated FT tail gas (transported by recirculating conduit 802) may be combined with oxygen introduced via a second oxygen inlet 1102 and burned in a pre-combustor 1100. In certain embodiments, the air-to-fuel ratio of the combined oxygen and recirculated FT tail gas in the pre-combustor 1100 is below the combustion equivalence ratio. In certain embodiments, the combined oxygen and recirculated FT tail gas may be heated by partial combustion to a temperature in a range of about 400° C. to about 1,000° C., for example, about 450° C. to about 950° C., about 500° C. to about 900° C., about 550° C. to about 850° C., about 600° C. to about 800° C., about 650° C. to about 750° C., or at any temperatures within the aforementioned ranges or sub-ranges. The heated FT tail gas 1101 may be introduced into the catalyst regenerator 1000 to be involved in the catalyst regeneration reaction.

Referring still to FIG. 4, the catalyst regenerator tail gas 1001 discharged after regenerating the reforming catalyst in the catalyst regenerator 1000 may be introduced into the catalytic reforming reactor 500. Alternatively, the catalyst regenerator tail gas 1001 may be introduced into the catalytic reforming reactor 500 after removing impurities or may be oxidized by oxygen introduced via a first oxygen inlet 501, e.g., to supply heat to the downstream process, to generate a oxidized catalyst regenerator tail gas 1003. The catalyst regenerator tail gas 1001 (or oxidized catalyst regenerator tail gas 1003) introduced into the catalytic reforming reactor 500 may additionally be used as a raw material and fuel in the catalytic reforming reaction to increase the production yield of hydrogen and carbon monoxide The oxidized catalyst regenerator tail gas 1003 (or catalyst regenerator tail gas 1001) is mixed with the second synthetic gas 403 to provide the reaction heat necessary for the catalytic reforming reaction in the catalytic reforming reactor 500.

Figure 5:
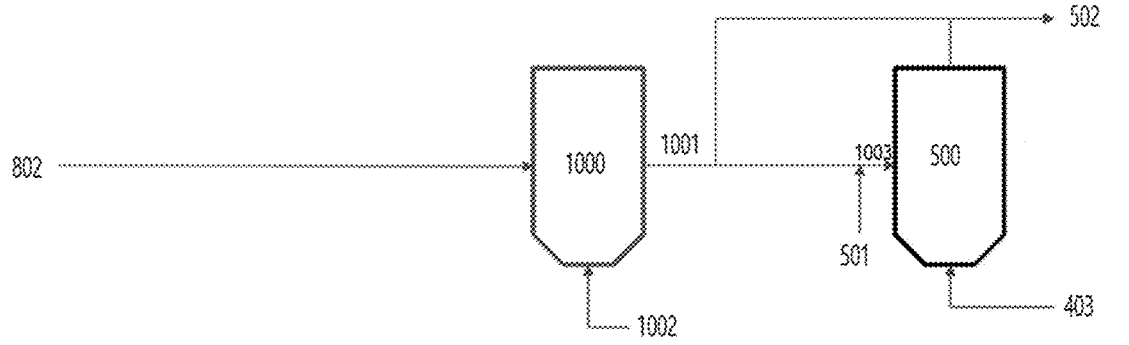
FIG. 5 is a flowchart of an exemplary process or system for supplying reaction heat to the catalyst regenerator.

FIG. 5 is a flowchart of another exemplary process for supplying reaction heat to the catalyst regenerator 1000 according to a further embodiment. The recirculated FT tail gas (transported by recirculating conduit 802) may chemically react with a third oxygen stream 1002 and burned in a catalyst regenerator 1000. In certain embodiments, the air-to-fuel ratio of the combined oxygen and recirculated FT tail gas in the catalyst regenerator 1000 is below the combustion equivalence ratio. The FT tail gas may be heated by the partial combustion to a temperature in a range of about 400° C. to about 1,000° C., for example, about 450° C. to about 950° C., about 500° C. to about 900° C., about 550° C. to about 850° C., about 600° C. to about 800° C., about 650° C. to about 750° C., or at any temperatures within the aforementioned ranges or sub-ranges. The heated FT tail gas 1101 may be introduced into the catalyst regenerator 1000 to participate in the catalyst regeneration reaction. In other words, the heated FT tail gas 1101 may act as a feed, fuel, or both in the catalytic regenerator 1000.

Referring still to FIG. 5, the catalyst regenerator tail gas 1001 discharged after regenerating the reforming catalyst in the catalyst regenerator 1000 may be introduced into the catalytic reforming reactor 500. Alternatively, the catalyst regenerator tail gas 1001 may be introduced into the catalytic reforming reactor 500 after removing impurities or may be oxidized oxygen introduced by a first oxygen inlet 501, e.g. to provide heat to the downstream process, to generate a oxidized catalyst regenerator tail gas 1003. The catalyst regenerator tail gas 1001 (or oxidized catalyst regenerator tail gas) introduced into the catalytic reforming reactor 500 may additionally be used as a raw material and fuel in the catalytic reforming reaction to increase the production yield of hydrogen and carbon monoxide The oxidized catalyst regenerator tail gas 1003 is mixed with the second synthetic gas 403 to. provide the reaction heat necessary for the catalytic reforming reaction in the catalytic reforming reactor 500.

In another aspect, the present disclosure provides a system for producing synthetic oil according to any of the processes and embodiments disclosed herein. In one embodiment, a system for preparing synthetic oil comprises:

- a section for producing a reformed synthetic gas comprising:
  - a feed inlet; and
  - one or more reactors to generate a reformed synthetic gas in the presence of a catalyst;
- a section for carrying out a Fischer-Tropsch (FT) process comprising:
  - an inlet for introducing the reformed synthetic gas;
  - an outlet for discharging synthetic oil;
  - an outlet for discharging an FT tail gas;
- section for regenerating catalyst; and
- a recirculating conduit or supplying the FT tail gas to the section for regenerating catalyst.

In one embodiment, a system comprises section for producing synthetic gas. A feed inlet provides a feed comprising a carbon material for carrying out a reaction in the presence of one or more catalysts to produce synthetic gas.

In one embodiment, the section for producing synthetic gas may comprise a sorter. The feed may be introduced into the sorter, and the sorter may sort the feed depending on the components of the feed. For example, the sorter may separate and remove metal materials from the feed.

In one embodiment, for example, as shown in FIG. 1, the section for producing synthetic gas may comprises one or more of a gasifier 300, a cyclone 400, a partial oxidation reactor (not shown), a catalytic reforming reactor 500, a water-gas shift reactor 700, a scrubber 600, or any combination thereof.

In one embodiment, the section for producing synthetic gas may further comprises one or both of a gas filter or a gas impurity removal device downstream of a cyclone 400.

For example, in one embodiment, carbonaceous raw material 201 discharged from the sorter 200 may be introduced into the gasifier 300 to produce a synthetic gas through a gasification reaction, as described herein. A first synthetic gas 302 discharged from the gasifier may be introduced into the cyclone 400 to remove undesirable solid materials 401 such as solid ash and slag.

In one embodiment, the first synthetic gas 302 discharged from the gasifier 300 or the second synthetic gas 403 discharged from the cyclone 400 may be introduced into a partial oxidation reactor then to a catalytic reformer 500 or directly into a catalytic reforming reactor 500. Hydrocarbons such as methane in the synthetic gases may be converted to carbon monoxide and hydrogen by a partial oxidation reaction in the partial oxidation rector, as described herein. Hydrocarbons such as methane in the synthetic gases may also be converted into carbon monoxide and hydrogen in a catalytic reforming reactor 500 as described herein, e.g., by a steam reforming reaction of methane or a dry reforming reaction.

In one embodiment, synthetic gas discharged from a partial oxidation reactor or catalytic reforming reactor 500 may be introduced into a water-gas shift reactor 700. In the water-gas shift reactor, carbon monoxide in the synthetic gas may be converted into carbon monoxide and hydrogen as described herein. Optionally, hydrogen may be introduced via a hydrogen input line 701 installed in the water-gas shift reactor 700.

In one embodiment, a scrubber 600 may be installed upstream or downstream of a partial oxidation reactor, catalytic reforming reactor 500, or water-gas shift reactor 700, respectively. The scrubber 600 may remove impurities using a scrubber solution such as water, oil, or NaOCl solution, depending on the type of impurities in the synthetic gas stream introduced into the scrubber.

Any reactor in the portion for producing synthetic gas may be operated in the swing mode as described above. For example, in certain embodiments, the portion for producing may comprise one or more catalytic reformers operating in swing mode.

The reformed synthetic gas thus produced may then be introduced into a Fischer-Tropsch reaction section in which synthetic oil 801 and FT tail gas may be produced through a Fischer-Tropsch (FT) reaction. The FT tail gas may be supplied to a catalyst regenerator 1000 in the section for producing synthetic gas via a recirculating conduit 802 and used to regenerate spent catalyst.

In one embodiment, the section of the system for regenerating catalyst may comprise a catalyst regenerator 1000, and the catalyst and FT tail gas may be supplied to the catalyst regenerator 1000 via a recirculating conduit 802.

In one embodiment, such as shown in FIG. 2, the section of the system for regenerating catalyst may further comprise a pre-heater 900, a pre-combustor 1100, or a combination thereof. As described herein, FT tail gas may be heated in the pre-heater 900 to a temperature in a range of about 400° C. to about 1,000° C., for example, about 450° C. to about 950° C., about 500° C. to about 900° C., about 550° C. to about 850° C., about 600° C. to about 800° C., about 650° C. to about 750° C., or at any temperatures within the aforementioned ranges or sub-ranges. Thereafter, the pre-heated FT tail gas 901 may be supplied to the catalyst regenerator 1000. The pre-heater 900 may be, but is not limited to, a gas-fired heater, an electric heater, or an induction heater.

In one embodiment, such as shown in FIG. 5, the pre-heated FT tail gas 901 may be introduced into the pre-combustor 1100. In another embodiment, the FT tail gas may be introduced into the pre-combustor without pre-heating. A second inlet 1102 may introduce oxygen or air into the pre-combustor 1100 for combustion. After being partially combusted in the pre-combustor 1100, the thus heated FT tail gas 1101 may be supplied to the catalyst regenerator 1000.

In one embodiment, a third oxygen inlet 1002 may supply oxygen to catalytic regenerator 1000, and the FT tail gas may be combusted in the catalytic regenerator 1000.

In one embodiment, such as shown in FIG. 3, the catalytic regenerator 1000 may comprise a heater 1010, for example, an electric heater or an induction heater, but is not limited thereto.

Hereinafter, examples of the present disclosure will be further described with reference to specific experimental examples. The examples and comparative examples included in the experimental examples only illustrate the present disclosure and do not limit the scope of the appended patent claims. It is obvious to those skilled in the art that various changes and modifications to the embodiments are possible within the scope and spirit of the present disclosure. It is natural that such variations and modifications fall within the scope of the attached patent claims.

Example 1

A method of preparing synthetic oil, the method including the process flow as described with respect to FIG. 1, was performed at a lab scale. A feed stream including food waste as biomass was subjected to a gasification reaction in a gasifier to produce a synthetic gas. The gasification reaction was carried out at a temperature of 760° C. and a pressure of 3.2 bara. The produced synthetic gas was introduced into a cyclone to remove ash and dust. The temperature and pressure inside the cyclone was 750° C. and 3.0 bara, respectively. The synthetic gas discharged from the cyclone was steam-reformed in a catalytic reformer provided with a nickel-based catalyst until the nickel-based catalyst was deactivated. The steam reforming reaction was carried out at a temperature of 700-800° C. and a pressure of 2-3 bara. When $CH_4$ in the synthetic gas reached a state where it could no longer be converted to CO or $H_2$ through a catalytic reaction, it was considered as a deactivation point. To remove solid and liquid impurities, the synthetic gas discharged from the catalytic reformer was introduced into a scrubber, which used water as a scrubber solution. The temperature and pressure inside the scrubber was 43° C. and 2.5 bara, respectively. The synthetic gas discharged from the scrubber was introduced into a Fischer-Tropsch reactor to produce synthetic oil and FT tail gas. The temperature and pressure inside the Fischer-Tropsch reactor was 200° C. and 23 bara, respectively. Using the produced FT tail gas as a regenerant, the deactivated nickel-based catalyst was regenerated in a catalyst regenerator to prepare a regenerated catalyst.

The composition and concentration of the FT tail gas were measured by gas chromatography.

TABLE 1

| Component | Content (volume %) |
|---|---|
| $CH_4$ | 9-15 |
| CO | 10-15 |
| $H_2$ | 11-30 |
| $CO_2$ | 3-30 |

TABLE 1-continued

| Component | Content (volume %) |
|---|---|
| $H_2O$ | ~1 |
| $C^{2+}$ | 2-3 |
| $N_2$ | 0-30 |
| Ar | 0-30 |
| Total | 100 |

Alternatively, composition information of the FT tail gas was obtained from an existing FT reactor. By regenerating the deactivated nickel-based catalyst with the use of a simulation gas of the same or similar composition, a regenerated catalyst may also be prepared.

Comparative Example 1

A fresh nickel-based catalyst not exposed to impurities was prepared.

Comparative Example 2

A regenerated catalyst was prepared by regenerating the nickel-based spent catalyst exposed to impurities with the use of a general regeneration gas (including $H_2O$ and $H_2$).

Comparative Example 3

A spent catalyst exposed to impurities and not regenerated was prepared.

Figure 6:
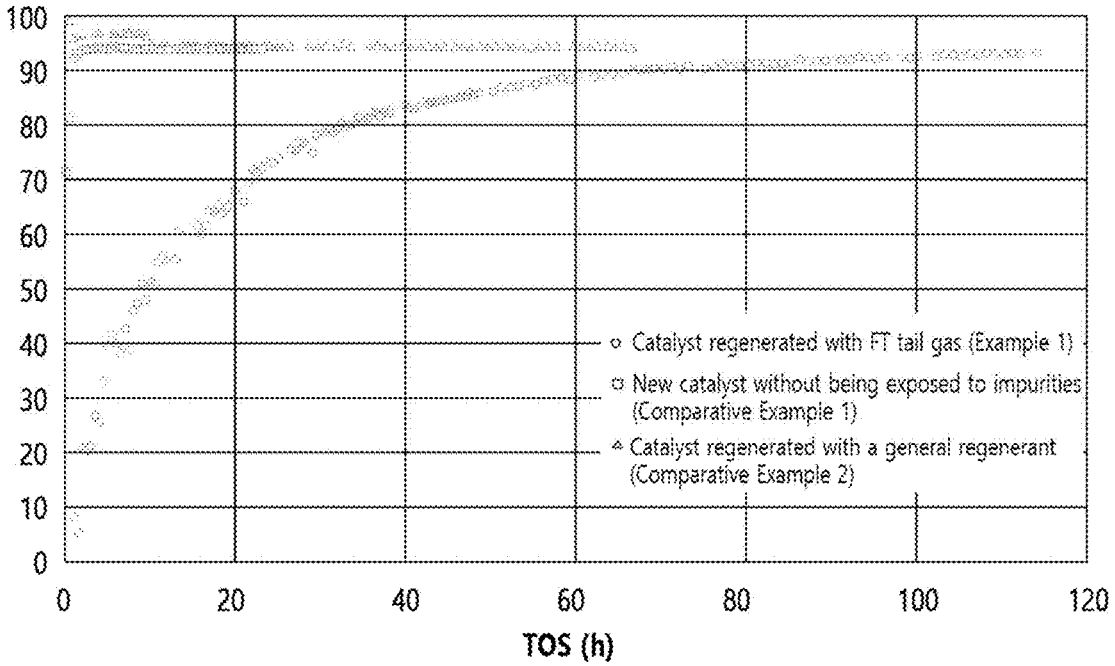
FIG. 6 is a graph showing the performance of a catalyst that converts methane over reaction time.

Experimental Example: Confirmation of Recovery of Activity of Catalyst Regenerated with Use of FT Tail Gas FIG. 6 shows the performance of the catalyst for converting methane included in the FT tail gas over the reaction time (time on stream: TOS). In other words, it is about measuring the ability of the catalyst to convert methane included in the FT tail gas. In the FT tail gas, 10 vol % $CH_4$, 30 vol % $CO_2$, 30 vol % $H_2$, 15 vol % CO, and 15 vol % $N_2$ were present. This reaction is where $CO_2$ and $CH_4$ react to produce $H_2$ and CO. In FIG. 6, the y-axis represents the conversion rate (%) of $CH_4$ under each catalyst.

Referring to FIG. 6, the regenerated catalyst O of Example 1, which was prepared by regenerating a deactivated catalyst through the reaction of FT tail gas, had low performance at the beginning of the reaction time. However, the performance of the catalyst was found to recover as the reaction time passed, reaching the level of the new catalyst □ in Comparative Example 1. In addition, the regenerated catalyst O of Example 1 was found to have equivalent performance to the catalyst Δ of Comparative Example 2 regenerated with the use of a general regeneration gas.

This showed that the $CH_4$ conversion rate in the FT tail gas was continuously improving as the $H_2$ in the FT tail gas acted to reactivate the catalyst.

In general, in the case of spent catalysts, it was impossible to convert $CH_4$ in the FT tail gas without a separate regeneration process. However, it was confirmed that it was possible to convert $CH_4$ in the FT tail gas by regenerating the catalyst using the FT tail gas.

Figure 7:
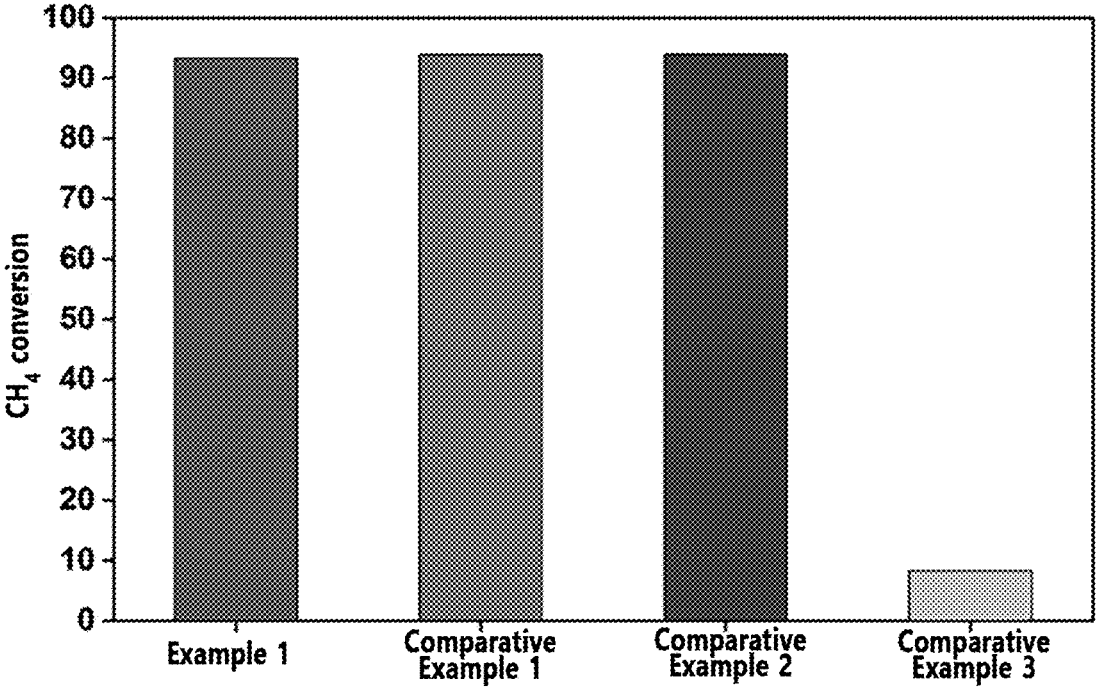
FIG. 7 is a graph showing the performance of a regenerated catalyst process or system.

The methane conversion performance of the catalysts of Example 1 and Comparative Examples 1 to 3 is shown in FIG. 7. In FIG. 7, the y-axis represents the conversion rate (%) of $CH_4$ under each catalyst.

Referring to FIG. 7, the catalyst regenerated according to Example 1 converted methane with performance comparable to those of the new catalyst (Comparative Example 1) and the catalyst regenerated with the use of separate general regeneration gas (Comparative Example 2). In other words, the catalyst of Example 1 had a similar performance to the catalysts of Comparative Examples 1 and 2. The catalyst of Example 1 had better performance than the spent catalyst of Comparative Example 3.

The contents described above are merely examples of applying the principles of the present disclosure. Other configurations may be further included without departing from the scope of the present disclosure.

What is claimed is:

1. A method of preparing synthetic oil, the method comprising:

producing a reformed synthetic gas from a feed comprising a carbon material using a catalyst;

subjecting the reformed synthetic gas to a Fischer-Tropsch (FT) process to produce synthetic oil and an FT tail gas;

regenerating the catalyst in a catalyst regenerator; and supplying the FT tail gas to the catalyst regenerator.

2. The method of claim 1, wherein the producing the reformed synthetic gas comprises a gasification reaction.

3. The method of claim 1, wherein the producing the reformed synthetic gas comprises a partial oxidation reaction, a catalytic reforming reaction, a water-gas shift reaction, a hydrogen injection, or any combination thereof.

4. The method of claim 1, wherein the producing the reformed synthetic gas comprises physically or chemically scrubbing the reformed synthetic gas.

5. The method of claim 1, wherein the method further comprises adjusting the FT tail gas to a temperature in a range of about 400° C. to about 1,000° C. before supplying the FT tail gas to the catalyst regenerator.

6. The method of claim 5, wherein the adjusting of the temperature of the FT tail gas comprises partially combusting the FT tail gas, pre-heating the FT tail gas, or a combination thereof.

7. The method of claim 1, wherein the method further comprises adjusting the catalyst regenerator temperature to a range of about 400° C. to about 1,000° C.

8. The method of claim 7, wherein the adjusting of the temperature of the catalyst regenerator is carried out by heating the catalytic regenerator with an electric heater or an inductive heater.

9. The method of claim 7, wherein the adjusting of the reaction temperature of the catalyst regenerator further comprises partially combusting the FT tail gas with oxygen.

10. The method of claim 1, wherein the catalyst comprises one or more of a nickel-based catalyst, an iron-based catalyst, a cobalt-based catalyst, a ruthenium-based catalyst, a platinum-based catalyst, or a rhodium-based catalyst.

11. The method of claim 1, wherein the producing of the reformed synthetic gas is carried out in two or more reactors operating in swing mode.

12. The method of claim 1, wherein the producing of the reformed synthetic gas is carried out in a circulating fluidized bed reactor.

13. The method of claim 1, wherein the method comprises generating a catalyst regenerator tail gas from the catalyst regenerator and wherein the catalyst regenerator tail gas is introduced into one or more processes downstream of producing the reformed synthetic gas.

14. A system for preparing synthetic oil, the system comprising:

a section for producing a reformed synthetic gas comprising:

a feed inlet; and one or more reactors to generate a reformed synthetic gas in the presence of a catalyst;

a section for carrying out a Fischer-Tropsch (FT) process comprising:

an inlet for introducing the reformed synthetic gas;

an outlet for discharging synthetic oil;

an outlet for discharging an FT tail gas;

a section for regenerating the catalyst comprising a catalyst regenerator; and a recirculating conduit for supplying the FT tail gas to the section for regenerating catalyst.

15. The system of claim 14, wherein the system further comprises a pre-heater, a pre-combustor, or a combination thereof downstream of the recirculating conduit for supplying the FT tail gas to the section for regenerating catalyst.

16. The system of claim 14, wherein the system further comprises a catalyst regenerator tail gas conduit for transporting tail gas generated from the catalyst regenerator to a catalytic reformer in the section for producing a reformed synthetic gas, optionally wherein the tail gas conduit for transporting tail gas generated from the catalyst regenerator to a catalytic reformer comprises an oxygen inlet.

17. The system of claim 14, wherein the system further comprises one or more oxygen inlets, optionally wherein one or both of the catalyst regenerator and recirculation conduit comprises an oxygen inlet.

18. The method of claim 1, wherein the FT tail gas comprises methane.

19. The method of claim 1, wherein supplying the FT tail gas to the catalyst regenerator converts methane in the FT tail gas to a catalyst regenerator tail gas comprising $H_2$ and CO and supplying the catalyst regenerator tail gas upstream of a catalytic reforming unit.

20. The method of claim 1, wherein the carbon material is biomass.

* * * * *